United States Patent [19]

Laing

[11] 4,004,426

[45] Jan. 25, 1977

[54] THERMAL PRIME MOVER

[76] Inventor: Nikolaus Laing, Hofener Weg 35-37, 7141 Aldingen near Stuttgart, Germany

[22] Filed: July 30, 1973

[21] Appl. No.: 383,537

Related U.S. Application Data

[63] Continuation of Ser. No. 152,946, June 14, 1971.

[52] U.S. Cl. ..... 60/659; 60/669; 165/86; 122/11

[51] Int. Cl. ..... F01k 1/00; F01k 3/00

[58] Field of Search ..... 60/108, 641, 659, 664, 60/676, 682, 669; 122/11; 165/105, 669, 86

[56] References Cited

UNITED STATES PATENTS

| | | | |
|---|---|---|---|
| 2,060,612 | 11/1936 | Dake | 60/108 R |
| 2,140,175 | 12/1938 | Starziczny | 60/108 R |
| 2,525,804 | 10/1950 | Kellogg | 60/108 R |
| 2,576,284 | 11/1951 | Crocchi | 60/108 R |
| 2,820,348 | 1/1958 | Sauter | 60/659 |
| 2,933,885 | 4/1960 | Benedek et al. | 60/659 |
| 3,563,035 | 2/1971 | Raymond | 60/108 R |
| 3,613,368 | 10/1971 | Doerner | 60/108 R |

FOREIGN PATENTS OR APPLICATIONS

| | | | |
|---|---|---|---|
| 645,870 | 7/1928 | France | 60/655 |

*Primary Examiner*—Martin P. Schwadron
*Assistant Examiner*—H. Burks, Sr.
*Attorney, Agent, or Firm*—Karl F. Ross; Herbert Dubno

[57] ABSTRACT

The apparatus described comprises two rotating heat exchangers, which serve as a heat source and a heat sink respectively, and which are designed to act simultaneously as fans. Owing to a very small separation between the annular rotating heat-exchange surfaces, the fans function with extremely low noise. These heat exchangers form a unit with a casing rotatably supported in bearings and their heat-exchange surfaces communicate with the inside of the casing. An expansion engine is located inside the casing and may be designed as a high-speed turbine or as a high-speed displacement motor.

1 Claim, 8 Drawing Figures

THERMAL PRIME MOVER

This is a continuation of application Ser. No. 152,946, filed 14 June 1971.

My present invention relates to a thermal prime mover, more particularly to a power plant for driving road vehicles, comprising a rotating evaporator, an expansion engine driven by a vaporizable working fluid, a rotating condenser and a source of heat.

There have been prior proposals for so-called Rankine-type plants of this kind which, however, failed to find practical application either because the working rotational speed would have to be very low, owing to the large mass of the rotating elements, or because two independent engines are needed, one of which must be designed for very low rotational speeds. In both cases, the hardware would therefore have to be heavy so that such engines would be unsuitable for driving vehicles, the power/weight ratio being impractical for such application.

Arrangements in which the vapor space has to be sealed with rotating shaft seals have the drawback that, in operation, continuous losses of fluid are practically inevitable; such losses, aside from being possibly dangerous in themselves, would require frequent replenishment. Finally, all prime movers depending on vaporization as part of their cycle need a substantial heating-up period.

It has also been previously proposed to use large containers as storage devices which can act as energy sources for a gas engine during prolonged periods, instead of storage units made of stainless-steel netting which can store only the heat sufficient for a single cycle as in still other proposals. These proposals have not hitherto achieved any significance in practice because such containers not only are exposed to temperatures of about 1000° C., and thus require a high degree of insulation, but also must sustain the very high compression pressure of modern gas-cycle engines at an operating frequency of about 50 cycles per second.

The object of my invention is to provide a power plant, suitable for use in a vehicle, satisfying the following requirements:

1. The heat sources must not generate excessive toxic or polluting exhaust gases.
2. The power/weight ratio must be reasonably comparable to that of conventional vehicle engines.
3. Rapid-starting capacity.
4. High acceleration capacity, i.e. "boost" power, particularly for overtaking (i.e. ready availability of stored heat).
5. Low operating noise level.
6. Lowest possible maintenance.

A prime mover according to the invention, satisfying the aforestated desiderata, comprises two rotating heat exchangers which serve as a heat source and a heat sink, respectively, and which are designed as a pair of rigidly interconnected radial blowers centered on a common axis of rotation. Thanks to very small spacing between the annular rotating heat-exchange surfaces, the blowers function with extremely low noise. These heat exchangers form a unit with a casing rotatably supported in bearings and their heat-exchange surfaces communicate with the inside of the casing. An expansion engine is located inside the casing and may be designed as a high-speed turbine or as a high-speed displacement motor. This engine drives an energizing unit contained in a hermetically sealed space, forming part of an electrical, magnetic, hydraulic or pneumatic transmission system, such as an electrical generator, a magnetic pole ring, a hydraulic pump or a pneumatic compressor, so that no drive shaft has to penetrate the hermetically sealed rotating part of the prime mover. The rotating evaporator-type heat exchanger forms simultaneously a suction blower for a heat carrier heated alternately by an external heat source, such as a continuous-combustion system for hydrocarbon fuels, or by a heat store. In principle, operation is possible with any type of external heat generation including electric heating; practical considerations will determine the choice.

A preferred primary heat store consists of a container filled with a fusible substance, preferably a salt-type material with a largely ionic bond and with a high enthalpy of fusion. Heat charging can be performed alternatively by the fuel of the power plant or electrically. The capacity of the heat store is intended to be appropriately so rated for road vehicles that in congested traffic the vehicle can be driven by stored energy, whereas outside the inner urban areas the vehicle is operated by its burner; thus, in pollution-sensitive areas no fuel need be burned.

The drive of the rotating unit, which consists of the two heat exchangers and a counterrotating part of the engine, is preferably effected by utilizing the reaction torque of the engine whose output shaft rotates at any desired high speed and which therefore may be of low weight. This form of drive ensures that, with increasing power output of the power plant, the rotational speed of the rotating unit increases so that both the gas flow is increased through the heat-absorbing first heat exchanger (the evaporator) to increase the power supplied and the cooling-air flow through the heat-releasing second heat exchanger (condenser) is raised to enhance the rate of heat dissipation of the cycle. Both the useful torque developed at high rotational speed and the motor speed can be greatly increased for short periods if an additional heat source and/or heat sink are provided in the circuit of the working fluid. In such case the heat store in the heat-absorbing unit may be in the form of containers which are filled with a fusible heat-storage substance. The melting point of such substance is so chosen that it lies above the operating temperature of the working fluid and below the melting point of the heat-storage substance of the primary heat store. By means of an injection system, working-fluid condensate is temporarily sprayed over these storage containers in order to increase vaporization. Since the condenser, too, should be able to exchange a larger heat flow during a period of increased heat generation, I may also provide in the heat-releasing unit, if necessary, further containers with a fusible substance whose melting point lies above the normal operating condenser temperature but below the maximum condenser temperature encountered under overload conditions. Since the overload or boost period (e.g. the time necessary for overtaking) usually lasts only a few seconds, the evaporation of water which is mixed in finely atomized form with the cooling air serves as a suitable means for the short-period additional cooling of the condenser.

The above and other features of my invention will now be described in detail with reference to the accompanying drawing in which.

Figure 1:
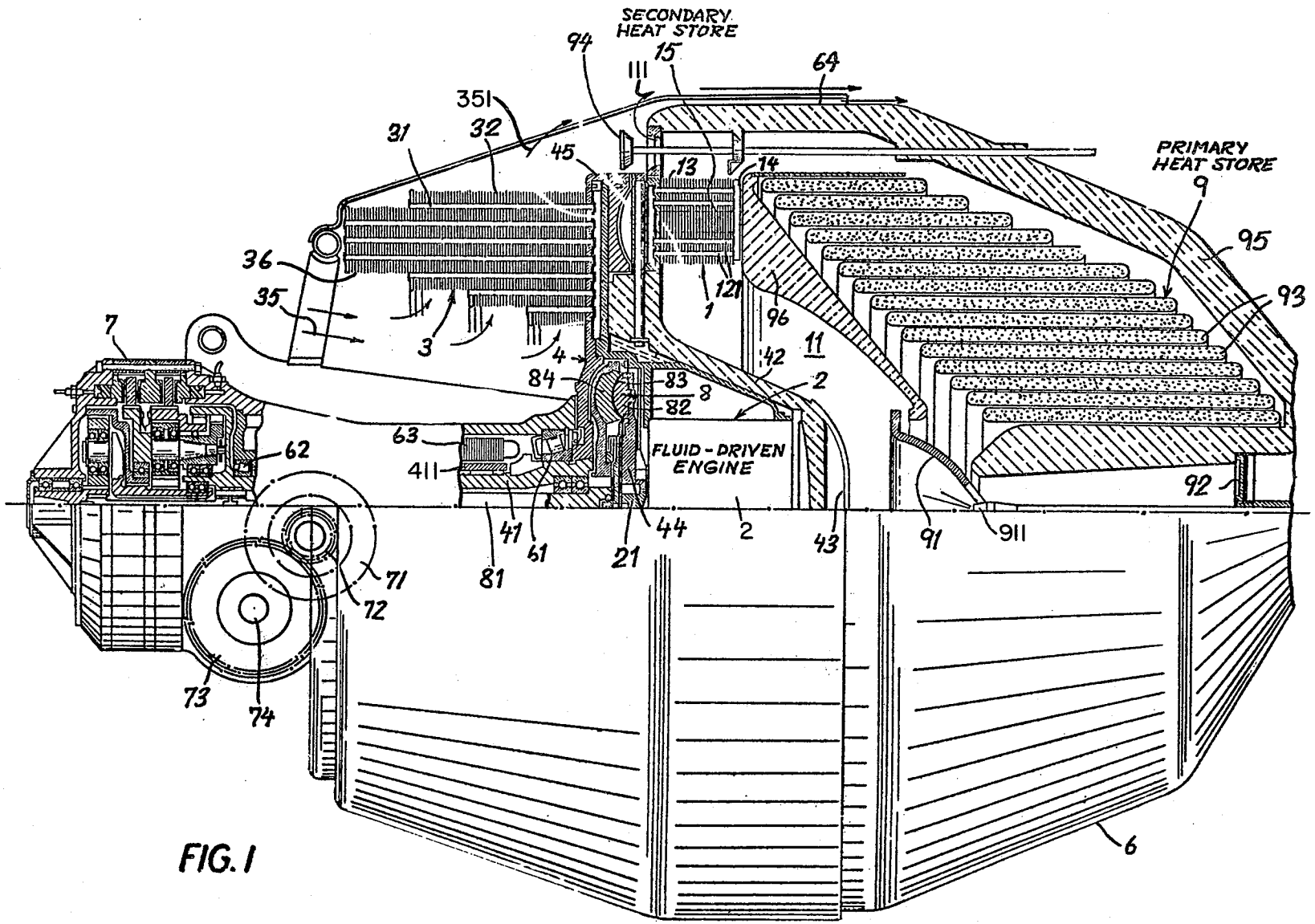
FIG. 1 is a side-elevational view, partly in axial section, of a power plant embodying my invention.
Figure 2:
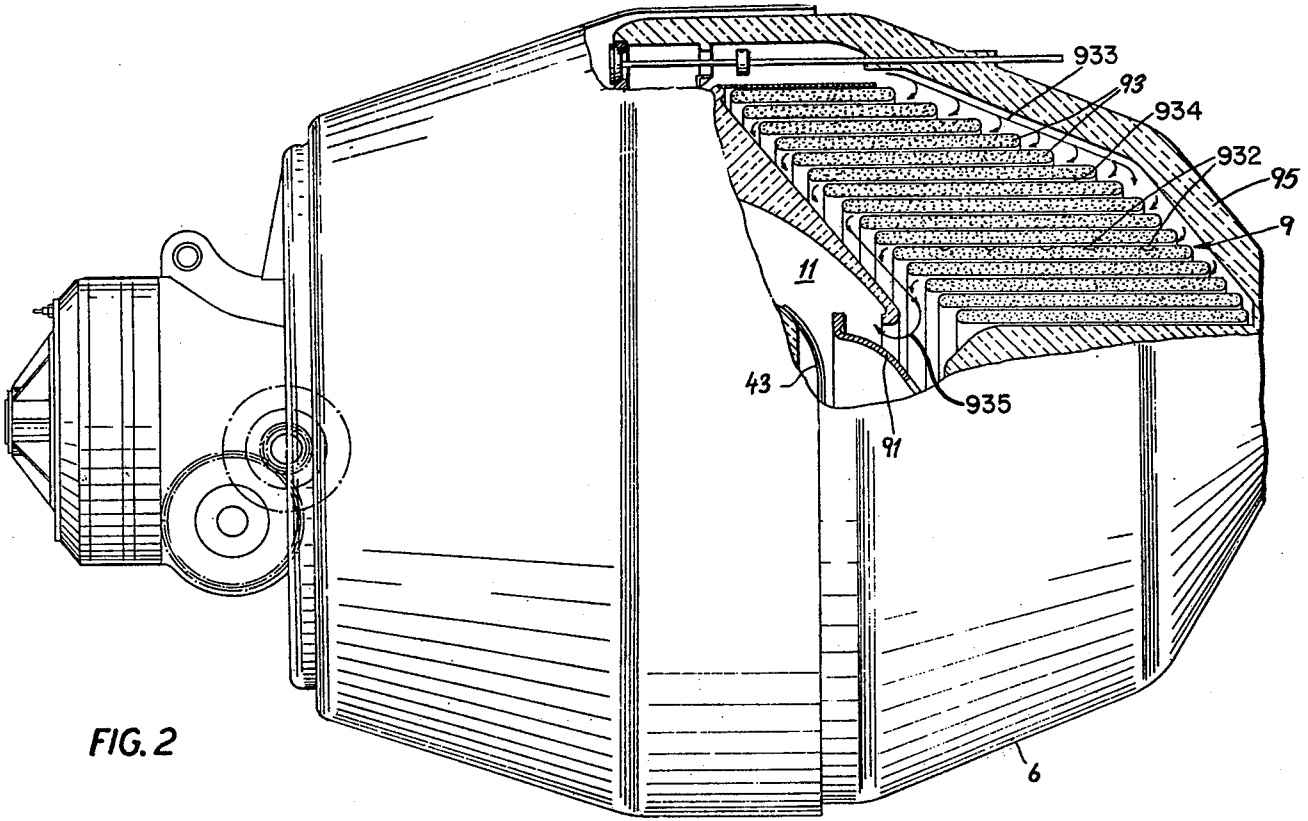
FIG. 2 is a view similar to FIG. 1, illustrating a different operating position.
Figure 3A:
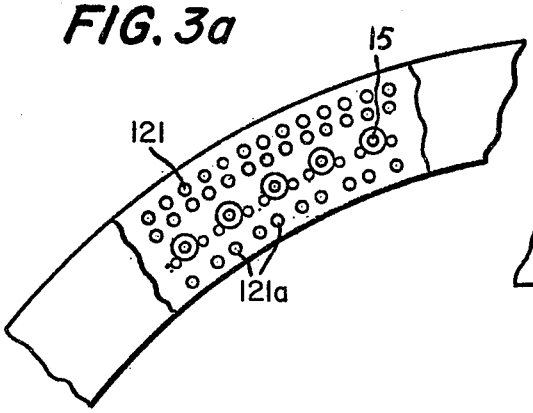
Figure 3B:
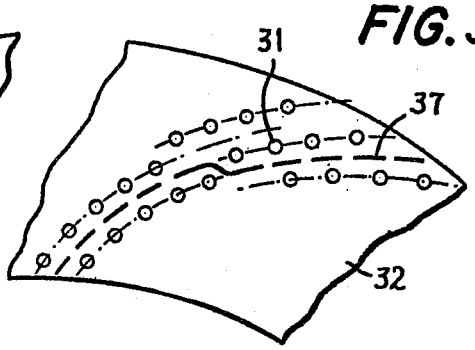
Figure 3C:
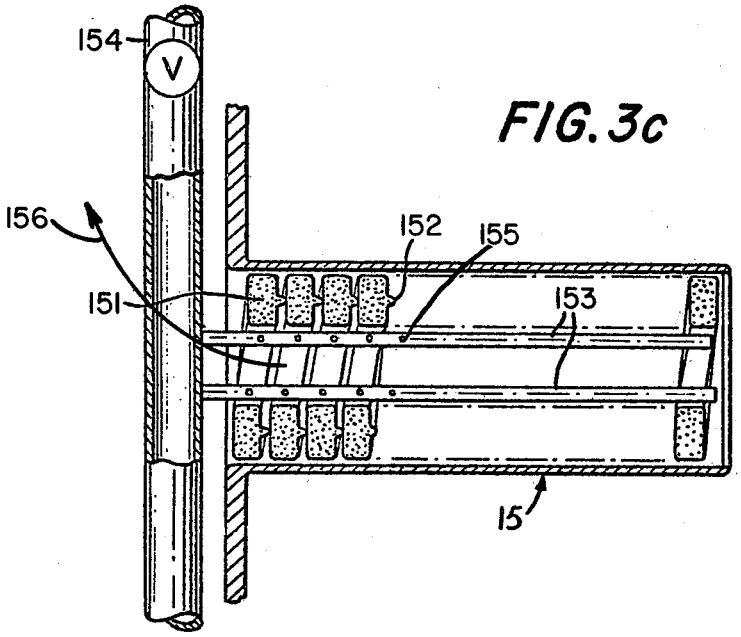

FIG. 3*a* is a fragmentary face view, partly in section, of a rotary evaporating heat exchanger included in the system of FIGS. 1 and 2;

FIG. 3*b* is a similar fragmentary view of a rotary condensing heat exchanger forming part of the system;

FIG. 3*c* is an enlarged longitudinal sectional view of a secondary heat store included in the evaporator of FIG. 3*a;*

Figure 3D:
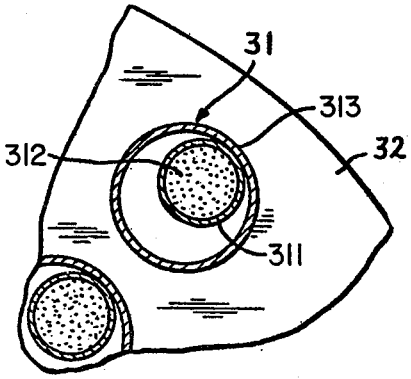

FIG. 3*d* is an enlarged cross-sectional view of a tube forming part of the condenser of FIG. 3*b;*

Figure 4:
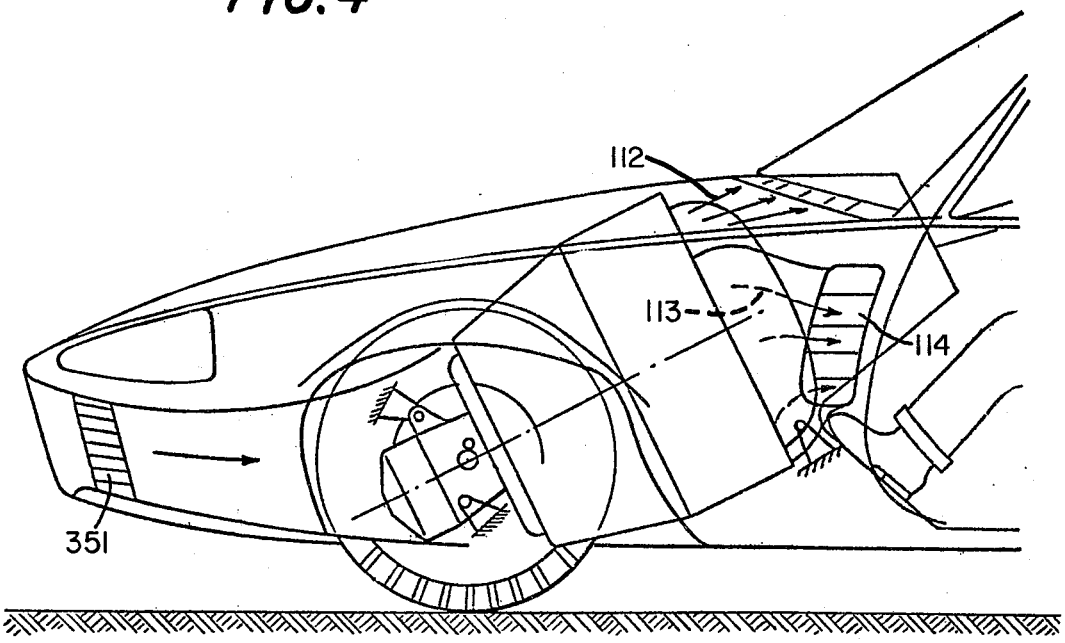
Figure 5:
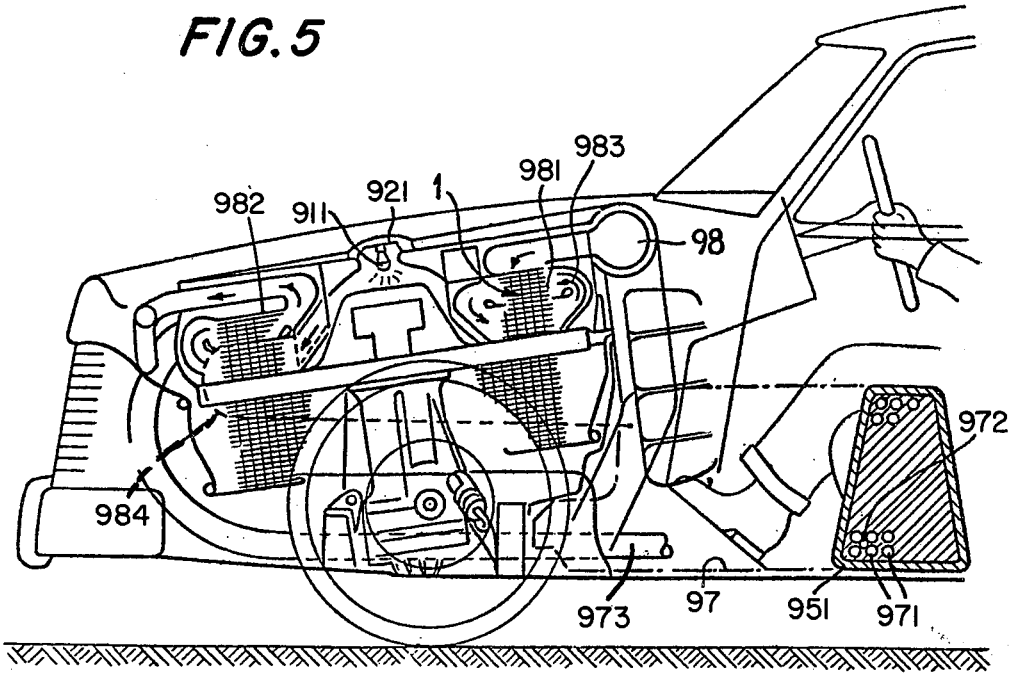

FIG. 4 is a somewhat diagrammatic side view of the fore section of an automotive vehicle equipped with a power plant according to my invention; and FIG. 5 is a view similar to FIG. 4 but with parts of the vehicle body broken away to show details of a modified plant.

In the system of FIG. 1, working fluid is evaporated in tubes 121 of an annular evaporating heat exchanger 1, reaches a displacement motor 2 and, after expansion, flows through tubes 31 of an annular condensing heat exchanger 3. The elements 1, 2 and 3 are carried by a rotating casing 4, unitary with a hollow shaft 41, which is supported by bearings 61 and 62 in a non-rotating housing 6. The subassembly consisting of heat exchangers 1 and 3, engine 2, casing 4 and shaft 41 forms a single rotating unit journaled in the housing 6. The torque of the motor 2 is transmitted via a magnetic coupling 8 and a shaft 81 to a gear train 7. A composite heat source generally indicated at 9 supplies the evaporating heat exchanger 1 with heat and consists of an oil-burner nozzle 911, enshrouded by a baffle 91 (also acting as a valve), an air-control device 92, a latent-heat store 93, heated by combustion gases or electrically so as to be available as a secondary heat source, a ring valve 94 and insulating walls 95 and 96. Tubes 121 and 31 are parallel to the common axis of rotation of heat exchangers 1 and 3.

The magnetic coupling 8 consists of a first magnetic pole ring 82, with a surface convex toward an adjoining air gap, which is mounted on the shaft 21 of the motor 2, a magnetically permeable transversely curved partition 83, and a complementarily concave second permanent-magnet pole ring 84 attached to the shaft 81 and defining that air gap with ring 82. The rotating casing 4 includes an insulating wall 42 and a radiation reflector 43 which bound a combustion chamber 11. The wall region 44 of the rotating casing 4 is connected with the remainder of this casing by the magnetically permeable thin partition 83. The interior of the casing communicates with the axially extending tubes 121 and 31 of the evaporator and the condenser, respectively, each of these tubes being closed at one end; the rotating casing is therefore formed as a hermetically sealed enclosure. The heat exchangers 1 and 3 have approximately radially disposed annular fins 13 and 32, in thermally conductive contact with the tubes 121 and 31 between which the gases are centrifuged by frictional entrainment so that the heat exchangers 1 and 3 act simultaneously as centrifugal fans or blowers. Heat energy is provided, as may be operationally required, alternatively either by the combustion of oil introduced through the head 911 or by secondary heat store 93. The stator 63 of an electric starter motor drives the rotor 411 of this motor and, together with it, the rotating casing 4. Heat exchangers 1 and 3 convey air which leaves the power plant through a ring slot 64. The air sucked in through the air control 92 by the fan action of the evaporating heat exchanger 1 mixes with the atomized or vaporized fuel from the nozzle or head 911. The mixture is initially ignited by a spark plug or other conventional igniter (not shown); the hot combustion gases traverse the evaporating heat exchanger 1 and subsequently, in one of the two phases of operation, emerge through the ring valve 94 as shown by the arrow 111. The working fluid for the motor 2 is contained in the tubes 12 in which it evaporates before being fed to the motor 2. Condensation of the vaporized working fluid, after partial cooling by expansion in the motor, takes place in the tubes 31 so that the air sucked in as indicated by arrow 35, by the rotation of the heat exchanger 3, is heated and leaves the condensing heat exchanger as indicated by the arrow 351. The radial dimension of the fins 32 of this heat exchanger increases toward the rotating casing 4. The spacing between the fins 32 is the larger the farther the fins extend radially, though it is not practical to show this in the Figure. These parameters are so chosen that the speed distribution in the suction stream indicated by the arrows 35 is approximately constant over the whole exchange area.

In the annular space 45, the condensate of the working fluid accumulates and is forced as liquid into the tubes 12 by means of a feed pump (not shown) driven by the motor. The torque of the motor 2 is transmitted to the gear transmission 7 via the pole rings 82 and 84. The reaction torque of the motor 2 drives the rotating casing 4 in the opposite direction so that, when a prescribed minimum rotational speed is reached, the electric starter motor 63, 411 can be switched off. For increased torque, the power supplied to the working-fluid vapor circuit is increased.

Since the rotating casing 4 is driven by the reaction torque of the motor 2, automatic matching occurs in first approximation between the flow of combustion air and condenser air in accordance with the demand of the vapor circuit as a function of the torque transmitted by the shaft 81. During idling, the shaft 81 is locked: this is facilitated by the epicyclic transmission 7, as more fully described below. The entire power output of the motor 2 in this condition is devoted to driving the heat exchangers 1 and 3, there being no counterrotation in this condition.

The rating of the motor is sufficient normally to achieve the prescribed maximum vehicle speed. Inside the heat exchanger 1, a number of secondary heat-storage containers 15 are located which are filled with a fusible latent-heat-storage substance whose melting point is above the maximum temperature of the working fluid and below the melting point of the storage substance in the heat store 93. These secondary heat-storage containers 15 are made with a large internal heat-transfer area. However, if temporarily above-normal maximum power (i.e. boost power) is demanded of the power plant, a distribution system (not shown) feeds working-fluid condensate into the secondary heat-storage containers 15 so that, temporarily, an increase of the normal vapor flow is supplied at higher pressure to the motor 2. The secondary heat-storage containers 15 are arranged between the tubes 12 and 121 at a point where sufficient heating-up is ensured without, however, reaching temperatures which are too high for the heat-storage substance and for the container materials. A typical arrangement is diagrammatically shown in FIG. 3*a*.

In the condensing heat exchanger 3 containers 36, indicated by broken lines, can be provided in the shape of thin-walled tubes which are filled with a fusible heat-storage substance, preferably a metal-salt hydrate (e.g. trisodium phosphate dodecahydrate or barium hydroxide octohydrate). These form a further secondary heat-storage device. The additional condensation heat developed during a boost requirement is partly removed by increased heating of the condenser cooling air and partly stored temporarily by the fusion of the heat-storage substance in the tubes 36 and the heating-up of the condenser heat exchanger 3 which consists preferably of aluminum. The thermal capacity of the first secondary heat-storage devices 15 is preferably so rated that during a period of temporary requirement for boosted power, as for overtaking, an increase above the normal maximum continuous power is available by virtue of the secondarily stored heat from units 15. The secondary heat stores 15 and 36 also serve as energy source and sink, respectively, in the case of sudden re-acceleration, for example, after a downhill run during which the rotational speed of the rotating system 1, 2, 3 and 4 may have been reduced because of the small torque required on such run. The torque transmitted to the gear transmission 7 is fed to the bevel-gear wheel 71 via an epicyclic planetary transmission, wheel 71 being rigid with a pinion 72. This, in turn, drives a gear wheel 73, coupled to the wheels of the vehicle via a shaft 74, the train so provided affording speed reduction.

FIG. 2 shows the power plant according to FIG. 1 in the alternative phase of operation in which, by adjusting the valves 94, 92, the heat energy is supplied to the working fluid in the vaporizer from the latent-heat store 93 as a controlled alternative to oil burning. In this operational phase or condition the ring valve 94 is shut but the valve apertures 931 are open. The oil-burner head 911 is axially displaced together with the combustion baffle element 91 which in its capacity as a valve is now wide open. The latent-heat store 93 consists of hollow rings or spirals of thin heat-resisting metal filled with ion-generating, salt-type compounds which melt above the heating-up temperature of the evaporating heat exchanger 1. Electrically insulated resistance conductors are embedded in grooves 932 for allowing the heat-storage substance to be melted by electric power using resistance heating. To this end, a supply cable (not shown) is connected to the mains energy supply using, for example, overnight supply which may be cheap. In this phase of operation starting is effected in the manner already described, except that fuel is not injected and the air-control device 92 is shut. The air contained in the combustion chamber 11 and in the insulating fixed casing 95 is circulated by the fan effect of the heat exchanger 1 and is heated up while flowing in the sense indicated by the arrows 933 through the axial, annular channels 934, between and in contact with the storage bodies 93, and proceeding as shown by the arrows 935 into the combustion chamber 11 whence it is finally led back again through the heat exchanger 1. The circulating air, which has been thus heated nearly to the temperature of the molten heat-storage substance contained in the bodies 93, gives up heat in the heat exchanger 1 to vaporize the working fluid therein. Thus operation of the vehicle is possible without the combustion of fuel and therefore without generation of any exhaust gas, by virtue of the latent heat stored in the bodies 93. This fuel-less operation is particularly important for inner urban zones but also for traveling through tunnels and in parking buildings, or under any conditions of high sensitivity to air pollution. Outside these sensitive areas, the oil-burner head 911 together with the baffle 91 is returned to its original (FIG. 1) position, the air-control device 92 is opened and the valve device 931 is shut while the ring valve 94 is opened. The energy supply is again provided as in FIG. 1 by the hot combustion gases resulting from fuel burning. The blades 14, which are rigid with the heat exchanger 1, circulate a small proportion of the hot combustion gases through the insulated casing 95 and remelting of the heat-storage substance takes place, in effect recharging the storage units. As soon as the total storage substance is melted, no further heat withdrawal takes place by reason of temperature equilibrium, so that the circulation indicated by the arrows 933 and 935 does not cause energy consumption, being thermally ineffectual. The insulated casing 95 consists preferably of a hollow wall filled with a mineral powder or foam in which the gas pressure has been sufficiently reduced to achieve the Knudsen effect.

Without fundamental modification, the combustion air can be preheated by being fed through passages of the charged heat-storage device 93 before it is mixed with the fuel from the nozzle 911, in order to increase the heat supply when short-term high-power requirements have to be met. If such a preheating is used, a larger flow of working fluid must be fed into the evaporator tubes 121.

In FIG. 3*a*, discussed above, and FIGS. 3*b*, 3*c*, 3*d* I have illustrated details of the rotating heat exchangers.

FIG. 3*a* shows a section of a fin 13 of the evaporator heat exchanger 1 indicating the location of the evaporator tubes 121, 121*a* (which are closed at one end) and the secondary-heat-storage containers 15, which are situated between an upstream group 121*a* and a downstream group 121 of evaporator tubes and are so located that they are neither directly exposed to the combustion gases nor so far away that the combustion gases have already cooled down when reaching them.

FIG. 3*b* shows a section of an annular or helical fin 32 of the condenser heat exchanger 3 with condenser tubes 31 arrayed along imaginary spiral lines 37. The fins 32 and the tubes 31 are made of light alloy, preferably a metal sandwich in which the core is made e.g. of aluminum alloy with 3% magnesium covered over its surfaces by a thin layer of a eutectic aluminum alloy which melts at a lower temperature, e.g. aluminum with 10% magnesium. This choice of materials facilitates the soldering of the tubes 31 (which are closed at one end) to the aluminum fins 32 and the casing 4.

FIG. 3*c* shows in diagrammatic form a secondary-heat-storage container 15 which has a good heat-conducting connection with helical hollow containers 151. The turns of the containers 151 are spaced apart by means of projections 152 and are filled with a fusible heat-storage substance. Working-fluid condensate is sprayed into the interspaces between the turns of the helical containers 151 via perforated pipelines 153 which are supplied by a ring manifold 152 and have perforations 155 within the helix formed by the containers 151. The condensate sprayed through the perforations 155 spreads over the surface and evaporates. The vapor emerges in the direction indicated by the arrow 156 and flows thence to the motor 2.

FIG. 3*d* shows tubes 31 of the heat exchanger 3. A tube 311, closed at both ends, is situated eccentrically inside each tube 31 and is filled with a fusible heat-storage substance 312. Along the line of contact 313, the walls of the outer and inner tubes provide adequate heat conduction.

FIG. 4 shows the installation of the power plant above described in a passenger automobile with front-wheel drive. The condenser-cooling air enters via the forward-facing air intake 351. Having been heated, this air and the cooled combustion gases are discharged, as indicated by the arrows 112 and 113, via lateral apertures 114 which guide the discharge rearwardly. Since, apart from the residual heat in the combustion air, the entire power loss is conducted via the condenser, the flow of cooling air through the condenser will be substantially greater than that of conventional internal-combustion-engine vehicles. The layout of the condenser heat exchanger and blower 3 is so conceived that the discharge velocity in the region 113, taking into account the heating of the air, is so related to the speed of the vehicle that a part of the blower power is recovered.

FIG. 6 shows a modification of the power plant according to the invention, intended primarily for vehicles for urban use. A heat-storage device 971, of greatly increased capacity compared with that of FIG. 1, is situated between the rows of seats and, once again, is enclosed in a super-insulation wall 951. The heat-storage substance is contained in internal tubes 971. The tubes 971 are bundled together in fours, to form a single long 4-start tube coil which surrounds an axially disposed resistance heating rod or a heat-conducting tube 972. The internal space of the heat store 97 is connected with a volute vapor manifold 98 via a pipeline 973, which communicates with a large number of finned heat-exchange tubes 981 located in a stationary heat exchanger. The rotating evaporator heat exchanger 1 (analogous to that of FIG. 1) generates an air flow 983 in the form of a toroidal vortex, whereby heat is given up by the tubes 981 and taken up by the exchanger 1. The heat store 97 is filled with a special evaporative heat carrier, e.g. sodium, which condenses in the tubes 981. The carrier condensate is returned to the heat-storage space via the pipeline 984 and spreads over the heat-storage tubes 971. This power plant has a fuel-injection nozzle 911 and an air-control valve 921. The heating up of the heat-storage device 97 is normally performed electrically from mains supply at intervals.

I claim:

1. A power plant comprising:

an engine adapted to be driven by the pressure of an expanding vaporizable working fluid;

heat-exchanger means fluidically linked with said engine, said heat-exchanger means including a condenser downstream of said engine and an evaporator upstream of said engine;

first conduit means for conducting said working fluid in a closed circuit through said engine and said heat-exchanger means;

second conduit means for conducting an external heat carrier through said heat-exchanger means in thermally interacting relationship with said working fluid whereby the latter absorbs heat from said carrier upstream of said engine and gives up heat to the environment downstream of said engine;

an external heat source operable to heat said carrier prior to entry thereof into said heat-exchanger means;

heat-storage means outside said closed circuit for heating said carrier prior to entry thereof into said heat-exchanger means in an inoperative state of said external heat source;

switchover means having a first and a second operating position for alternately making said external heat source and said heat-storage means effective to heat said carrier; and transmission means for operatively coupling said engine to a load;

said condenser and evaporator being a pair of rigidly interconnected radial blowers centered on a common axis of rotation, each of said blowers including a set of tubes extending substantially parallel to said axis.

* * * * *